US009714488B2

(12) United States Patent
Franzmann et al.

(10) Patent No.: US 9,714,488 B2
(45) **Date of Patent: *Jul. 25, 2017**

(54) ROAD MILLING MACHINE

(71) Applicant: Wirtgen GmbH, Windhagen (DE)

(72) Inventors: Dirk Franzmann, Hennef (DE); Christian Berning, Brühl (DE); Herbert Ley, St. Katharinen (DE); Cyrus Barimani, Königswinter (DE); Günter Hähn, Königswinter (DE)

(73) Assignee: Wirtgen GmbH (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/600,124

(22) Filed: Jan. 20, 2015

(65) Prior Publication Data

US 2015/0130257 A1 May 14, 2015

Related U.S. Application Data

(63) Continuation of application No. 13/790,682, filed on Mar. 8, 2013, now Pat. No. 8,939,515.

(30) Foreign Application Priority Data

Jun. 25, 2012 (DE) ..... 10 2012 012 395

(51) Int. Cl.
*E01C 23/08* (2006.01)
*E01C 23/12* (2006.01)
*E01C 23/088* (2006.01)

(52) U.S. Cl.
CPC ..... *E01C 23/127* (2013.01); *E01C 23/088* (2013.01)

(58) Field of Classification Search
CPC ..... E01C 23/06; E01C 23/065; E01C 23/127
See application file for complete search history.

(56) References Cited

U.S. PATENT DOCUMENTS 5,893,677 A 4/1999 Haehn et al.
6,296,318 B1 10/2001 Simons et al.
(Continued)

FOREIGN PATENT DOCUMENTS

CN 102312406 A 1/2012
DE 2160403 7/1973
(Continued)

OTHER PUBLICATIONS

European Search Report in European Patent Application EP 13 00 2816.0, dated Oct. 13, 2015, 2 pp. (not prior art).

*Primary Examiner* — John Kreck
(74) *Attorney, Agent, or Firm* — Lucian Wayne Beavers; Patterson Intellectual Property Law, PC

(57) ABSTRACT

The invention relates to a road milling machine, with a milling drum housing partially surrounding a milling drum, wherein the opening between the milling drum housing and the surface of the material to be milled can be closed off by a hold-down device. The distance between the axis of rotation and the hold-down device increases in the specified direction of rotation of the milling drum at least over a section of the gap between the milling drum and the hold-down device. The particular configuration of the hold-down device leads to an improvement in transport of the milled material to the transport arrangement. The gap width increasing in the direction of rotation of the milling drum improves material flow with a relatively small power requirement and relatively low wear of the milling drum.

16 Claims, 7 Drawing Sheets

(56) References Cited

U.S. PATENT DOCUMENTS

| | | | | |
|---|---|---|---|---|
| 7,370,916 | B2 | 5/2008 | Ley et al. | |
| 7,918,512 | B2 * | 4/2011 | Mannebach | E01C 21/00 299/39.4 |
| 7,976,239 | B2 * | 7/2011 | Hall | E01C 23/088 299/39.4 |
| 8,297,877 | B2 | 10/2012 | Erdmann et al. | |
| 8,939,515 | B2 * | 1/2015 | Franzmann | E01C 23/127 299/39.4 |
| 2008/0267706 | A1 | 10/2008 | Hall et al. | |

FOREIGN PATENT DOCUMENTS

| | | | |
|---|---|---|---|
| DE | 3921875 | A1 | 1/1991 |
| DE | 4324234 | A1 | 1/1996 |
| DE | 19547698 | A1 | 6/1997 |
| DE | 19726122 | A1 | 1/1999 |
| DE | 102008024651 | A1 | 4/2009 |
| EP | 1070788 | A2 * | 1/2001 |
| EP | 1522634 | A2 | 4/2005 |
| EP | 2050875 | A2 | 4/2009 |
| EP | 2378000 | A2 | 10/2011 |

* cited by examiner

ROAD MILLING MACHINE

BACKGROUND OF THE INVENTION

1. Field of the Invention

The invention relates to a road milling machine with a machine frame and a milling mechanism for milling off material.

2. Description of the Prior Art

The known road milling machines have a machine frame, which is supported by a chassis, and a milling mechanism, which comprises a milling drum for milling off material. The milling drum, which is rotatable about an axis transverse to the operating direction, is located in a milling drum housing.

Furthermore, the known road milling machines have a transport arrangement for conveying the milled material. In the known rear loader road milling machines, the transport arrangement is behind the milling drum housing, when seen in the operating direction, to allow it to feed the milled material, as far as possible free from residues, over the rear of the milling machine to the following truck. A rear loader road milling machine is known, for example, from DE 195 47 698 A1.

With the known road milling machines, the road surface can be milled true to contour and evenly. The so-called stabilisers or recyclers should be differentiated from road milling machines; the role of the former is to produce a stable substructure by addition of binding agents to unstable ground, for example loose soil (stabiliser) or a damaged roadway (recycler).

In the operation of the known road milling machines, particular requirements are demanded of the design of the milling drum housing. The milling drum housing should prevent the milled material being ejected. In particular, the risk of ejection of milled material exists in the operating direction of the milling machine if the milling drum is rotated in the direction opposite to the operating direction. The milling drum housing should also ensure that there is a continuous supply of milled material to the transport arrangement.

DE 10 2008 024 651 describes a rear loader road milling machine whose milling drum is positioned in a milling drum housing that surrounds the milling drum. A so-called hold-down device, which is mounted on a circular track concentrically surrounding the axis of rotation of the milling drum and is adjustable in height, serves to seal the milling drum housing from the surface of the material to be milled. In the known road milling machines, an aim is to have a uniform gap width for the gap between the tips of the milling tools of the milling drum and the inside of the hold-down device over the periphery of the milling drum. A uniform gap width should be obtained, independent of the set milling depth, where the hold-down device runs on a concentric circular track around the axis of rotation of the milling drum.

The stripping elements, which are located behind the milling drum, when seen in the operating direction, are to be differentiated from the hold-down devices. In the known stabilisers or recyclers, the mixed material should be uniformly removed with the stripping elements to a specified depth and evenly distributed.

SUMMARY OF THE INVENTION

The object of the invention is therefore to create a road milling machine with improved material transport of the milled material within the milling drum housing.

This object is achieved, according to the present invention, with the features of the independent patent claims. The dependent claims relate to advantageous embodiments of the invention.

The milling drum housing of the road milling machine in accordance with the invention is a fixed housing, which partially surrounds the milling drum. The opening between the milling drum housing and the surface of the material to be milled off, the depth of which varies with the set milling depth, can be closed with a hold-down device.

In the road milling machine in accordance with the invention, the hold-down device is configured so that the distance between the hold-down device and the milling drum housing increases in the specified direction of rotation of the milling drum, at least over a section of the gap between the milling drum and the hold-down device. Preferably, the distance between the axis of rotation of the hold-down device increases over the whole periphery of the hold-down device, so that the gap width increases over the whole length of the gap between milling drum and hold-down device. However, it is basically sufficient for the gap width to increase over only a section of the periphery of the hold-down device. In this connection, gap width should be understood as the distance between the inside of the hold-down device and a cylinder which encloses the tips of the milling tools of the milling drum.

The milling drum housing and the hold-down device preferably extend in the axial direction over the width of the milling drum. Preferably, the milling drum housing is closed at the sides by side plates.

In a preferred embodiment, both the distance between the axis of rotation and the milling drum housing, i.e. the gap width between milling drum and milling drum housing, and the distance between the axis of rotation and the hold-down device, i.e. the gap width between milling drum and hold-down device, increase upwards in the direction of rotation of the milling drum, i.e. from the surface of the material being milled. As a result, the hold-down device continues the contour of the milling drum housing.

The configuration of the hold-down device with increasing gap width leads to an improvement in transport of the milled material to the transport arrangement. It has been shown that the distance between the milling drum and hold-down device is particularly important for material flow, since the material is picked up in the region of the hold-down device. A uniform distance between milling drum and hold-down device leads to an undesired compaction of the milled-off material. This material compaction impedes transport of material over the milling drum to the rear. Furthermore, the material compaction requires higher power for the drum and leads to increased wear. It has also been shown that an excessively large gap, which requires less power for the drum and leads to reduced wear, also makes transport of material more difficult. The gap width increasing in the direction of rotation of the milling drum, in particular in the region of the hold-down device, improves material flow with a relatively small power requirement and relatively low wear.

While the milled material is conveyed through the gap in the direction of rotation of the milling drum, the packing density of the material can reduce without there being a risk that the material remains compacted or is compacted. As the packing density decreases, the milled material is first conveyed with increasing speed through the gap in the region of the hold-down device and later is ejected to the rear, so that the material can be picked up by the transport arrangement. The relatively small gap width at ground level results in lumps of material accumulating during milling being immediately broken up to the desired particle size.

A preferred embodiment provides that the hold-down device is guided displaceably on a guide track surrounding the milling drum between a first position, in which the hold-down device is lowered, and a second position, in which the hold-down device is raised. When the milling drum having a horizontal axis of rotation penetrates in the vertical direction into the material to be milled, the hold-down device is adjusted in height.

A particularly preferred embodiment provides that the lower edge of the hold-down device and the lower edge of the milling drum housing are essentially at the same level when the hold-down device is in the second position. The maximum milling depth is obtained in this position. However, it is also possible for the milling drum housing and the hold-down device partially to overlap at the maximum milling depth.

For the basic principle of the invention, it is not basically significant how the guide or mounting of the hold-down device is provided, as long as it has sufficient rigidity. In a preferred embodiment, adequate rigidity of the guide is obtained by extending guide elements around the periphery of the hold-down device, which are displaceably guided in the mounting elements surrounding the periphery of the hold-down device. However, as an alternative, it is also possible for the hold-down device to have mounting elements that are displaceably guided in guide elements.

The guide elements of the hold-down device preferably extend beyond the hold-down device, so that the guide elements enclose part of the periphery of the milling drum housing. As a result, the hold-down device can be supported on the milling drum housing via the guide elements when the hold-down device is in the lowered position. Thus the rigidity of the guide is further improved.

Preferably, two guide or mounting elements are provided and are positioned on either side of the milling drum housing or hold-down device. In principle, it is also possible for only one guide element or only one mounting element to be provided.

It has proved to be advantageous if a breaker element, extending in the direction of the axis of rotation of the milling drum, is positioned in the gap between milling drum and milling drum housing. Lumps of material accumulating during milling can be broken down to the desired particle size on the breaker element. However, the breaker element, extending in the direction of the axis of rotation of the milling drum, only comes into use when the lumps have not already been broken during transport through the gap.

While the road milling machine is moved in the operating direction, the opening between the lower edge of the milling drum housing and the surface of the material to be milled should always be tightly closed, regardless of the milling depth.

Tilting of the hold-down device can be avoided by positioning a skid on the lower edge of the hold-down device, with which the hold-down device rests on the material to be milled as the machine advances. With the skid, the hold-down device can move upwards in the guide against its contact force on impact with an obstacle.

In a further preferred embodiment, a mechanism is provided or lifting and lowering the hold-down device, so that the movement of the hold-down device is supported, in particular from the lowered to the raised position.

The mechanism for raising and lowering the sealing element preferably has a measurement unit, which is configured so that the measurement unit measures the force acting on the sealing element when the hold-down device encounters an obstacle. Furthermore, the mechanism for raising and lowering has a control unit, which is configured so that the control unit generates a control signal for raising the hold-down device when the force measured by the measuring unit is greater than a predetermined limit value, so that the hold-down device is raised, and a control signal is generated for lowering the hold-down device when the force is smaller than a predetermined limit value, so that the hold-down device is pressed on the ground with the predetermined contact force.

The force measured with the measuring unit is preferably the essentially horizontal force component acting on the hold-down device when it strikes an obstacle. However, it is also possible that the measured force has a vertical component.

The advantage of the sealing element in accordance with the invention is that obstacles in the operating direction of the construction machine are detected when the force acting on the hold-down device exceeds a limit value. When this is the case, the hold-down device is automatically raised. The hold-down device is only raised until the measured force is again below the limit value. In this case, it is assumed that the obstacle has been negotiated. The hold-down device is then lowered until the hold-down device rests on the ground with the predetermined contact force. The limit value for the measured force should be calculated so that the hold-down device is not raised just for very small obstacles.

In a preferred embodiment, the mechanism for raising and lowering the hold-down device comprises one or more piston/cylinder arrangements where their cylinders have an articulated connection to the machine frame and their pistons have an articulated connection to the hold-down device or their cylinders have an articulated connection to the hold-down device and their pistons have an articulated connection to the machine frame. The piston/cylinder arrangement can be operated hydraulically or pneumatically. However, an electric motor can also be used for height adjustment. The sub-assemblies required for this purpose are state of the art.

BRIEF DESCRIPTION OF THE DRAWINGS

In the following, an example of an embodiment of the invention is explained in detail with reference to the drawings.

These show.

DETAILED DESCRIPTION

Figure 1:
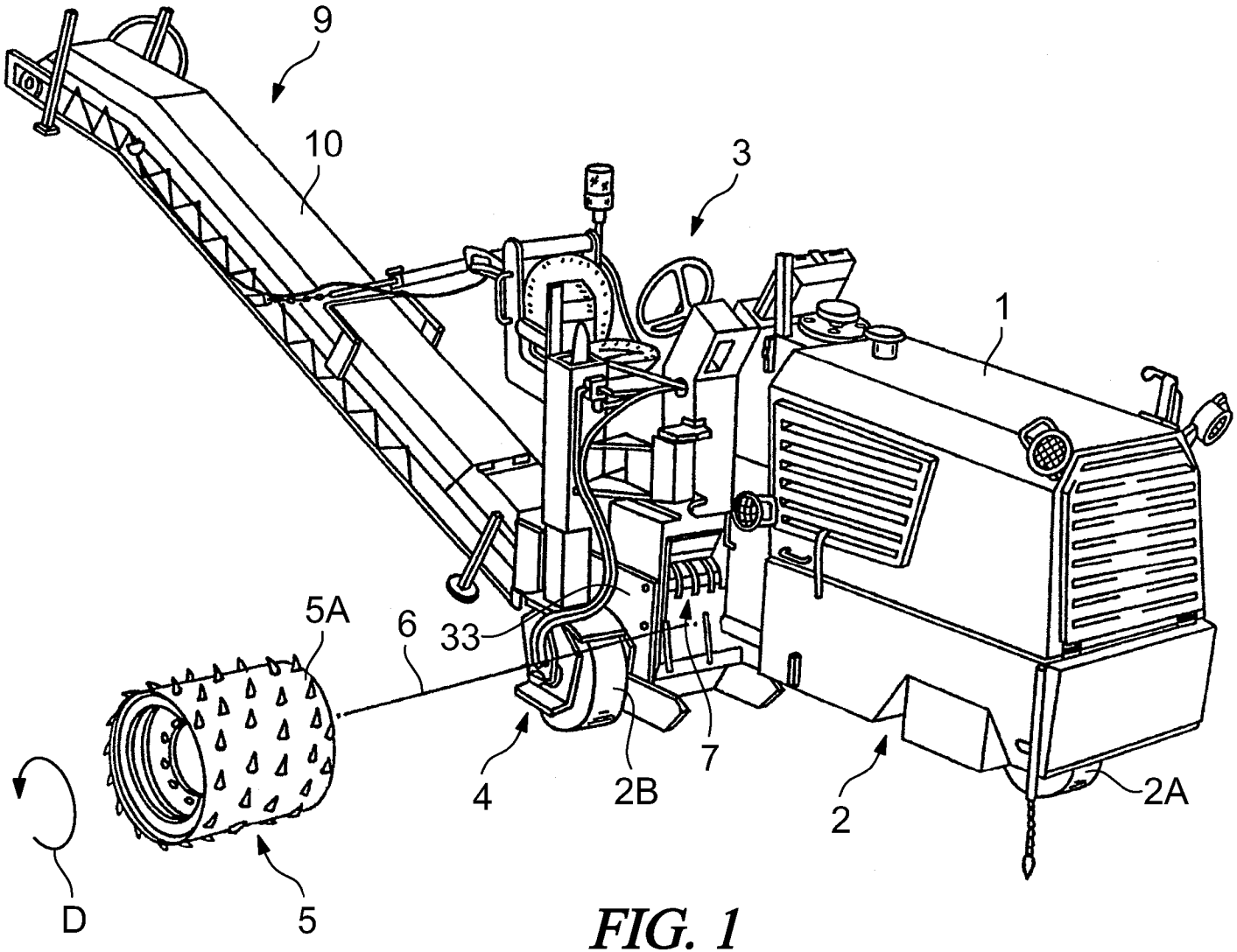
FIG. 1 a rear loader road milling machine in accordance with the invention in a perspective view, FIG. 2 a simplified schematic representation of the milling drum housing of the road milling machine in accordance with the invention, together with the milling drum and machine frame in a first operating position of the hold-down device, FIG. 3 the milling drum housing in accordance with the invention in a second operating position of the hold-down device, FIG. 4 the milling drum housing in accordance with the invention in a third operating position of the hold-down device, FIG. 5 a schematic representation of the milling drum housing, together with the milling drum, wherein the hold-down device is in a raised position, FIG. 6 the milling drum housing of FIG. 5, wherein the hold-down device is in a lowered position and FIG. 7 a section through a guide element and a mounting element of the guide of the hold-down device and FIG. 8 a further embodiment of the milling drum housing in accordance with the invention.

FIG. 1 shows in a perspective view a road milling machine, specifically a rear loader road milling machine. The road milling machine comprises a machine frame 1, which is supported by a chassis 2. The chassis 2 has a front wheel 2A and two rear wheels 2B, when seen in the operating direction. The operator's platform 3 is in the rear part of the machine frame. The milling mechanism 4 of the road milling machine is underneath the operator's platform 3.

The milling mechanism 4 comprises a milling drum 5, with cutting tools 5A spaced around its periphery. The milling drum 5 is positioned in a milling drum housing 7 about an axis of rotation 6 running transverse to the operating direction of the milling machine. The milling drum 5 rotates in the milling drum housing 7 in a predetermined direction of rotation D. In the present example, the milling drum 5 rotates in a counter-clockwise direction. The milling drum housing 7 enclosing the milling drum 5 has a discharge opening at the rear, when seen in the operating direction. The milling drum housing is closed off by side plates 33 on the longitudinal sides. On the milling drum housing 7 is the transport arrangement 9, with a conveyor belt 10 for conveying the milled material, which can be received by a truck driven behind the milling machine.

In the following, the milling drum housing 7 accommodating the milling drum 5 is described in detail with reference to FIGS. 2 to 8

The milling drum housing 7 is fixedly attached to the machine frame 1. The fastening members for the milling drum housing 7 are not shown in the Figures. In the Figures, the milling drum 5 is represented schematically by a cylindrical body that encloses the tips of the tools 5A of the milling drum 5. The milling drum housing 7 extends beyond the width of the milling drum 5 on both sides. It surrounds the milling drum 5 except for an opening 11A in front of the milling drum, when seen in the operating direction, and a discharge opening 11B behind the milling drum, when seen in the operating direction. The opening 11A at the front, when seen in the operating direction is closed by a hold-down device 8. The milled material is discharged to the rear and is picked up by the conveyor belt 9 of the transport arrangement 10. A stripper element in the rear part of the milling drum housing 7 is not shown in the Figures.

Figure 2:
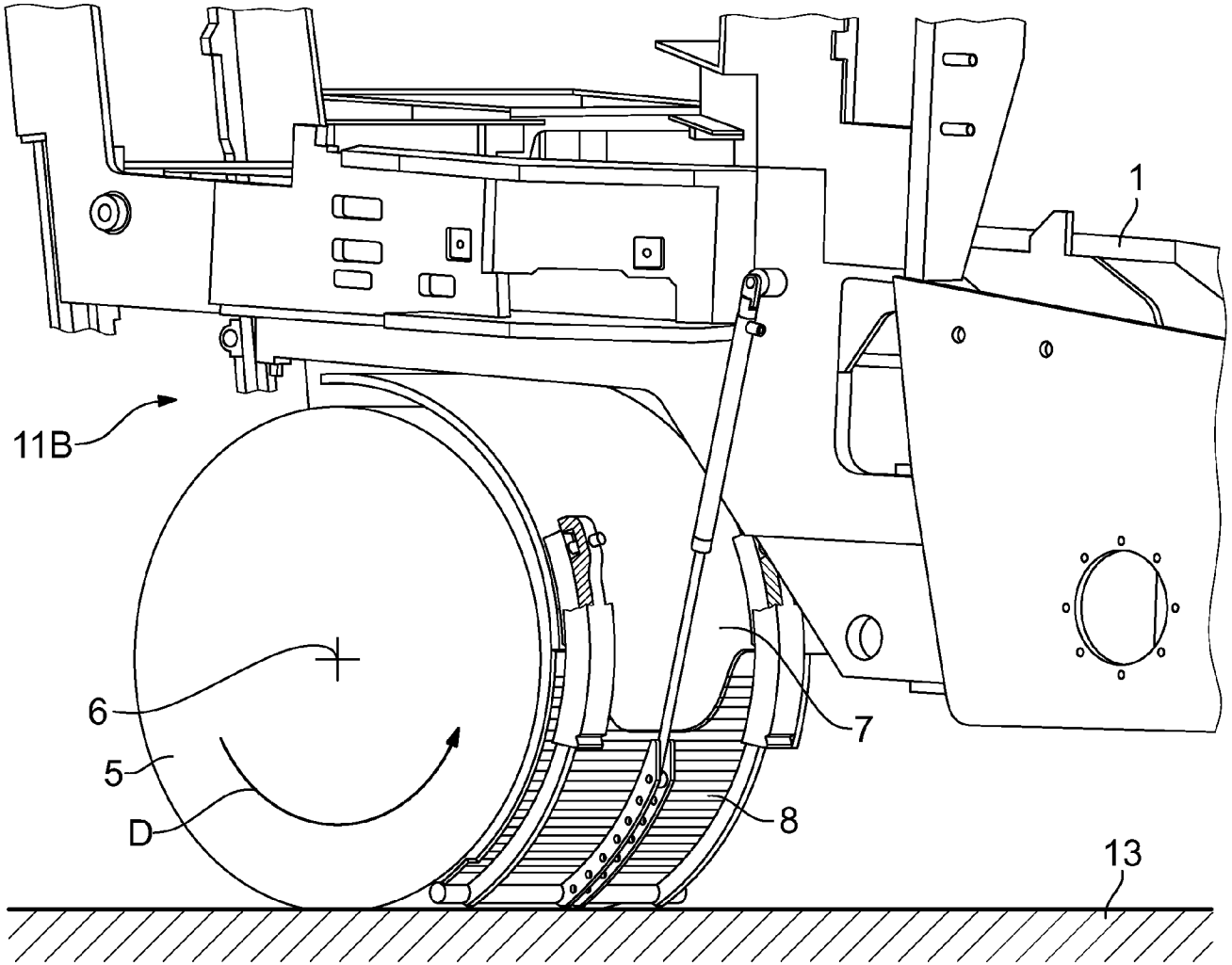
Figure 3:
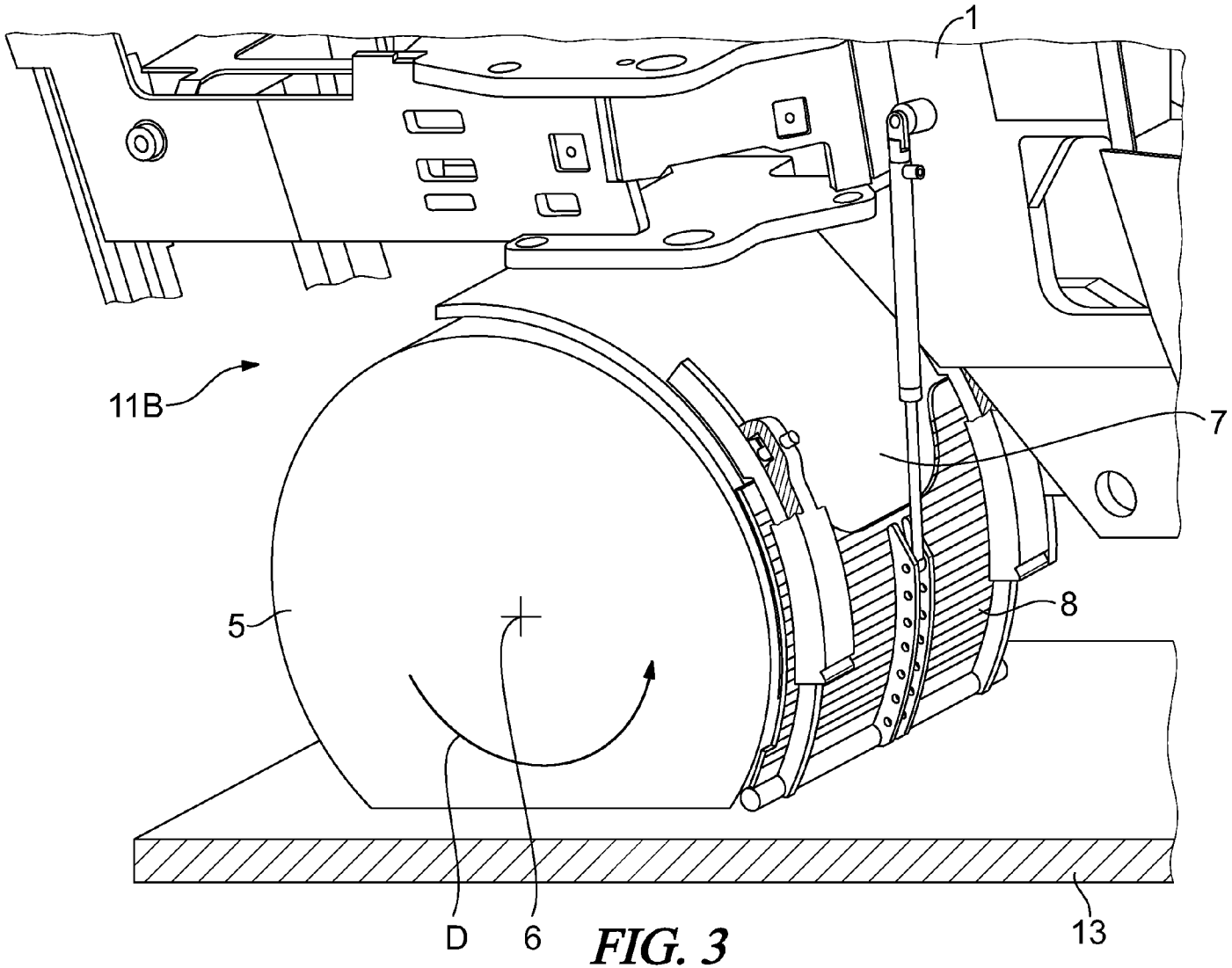
Figure 4:
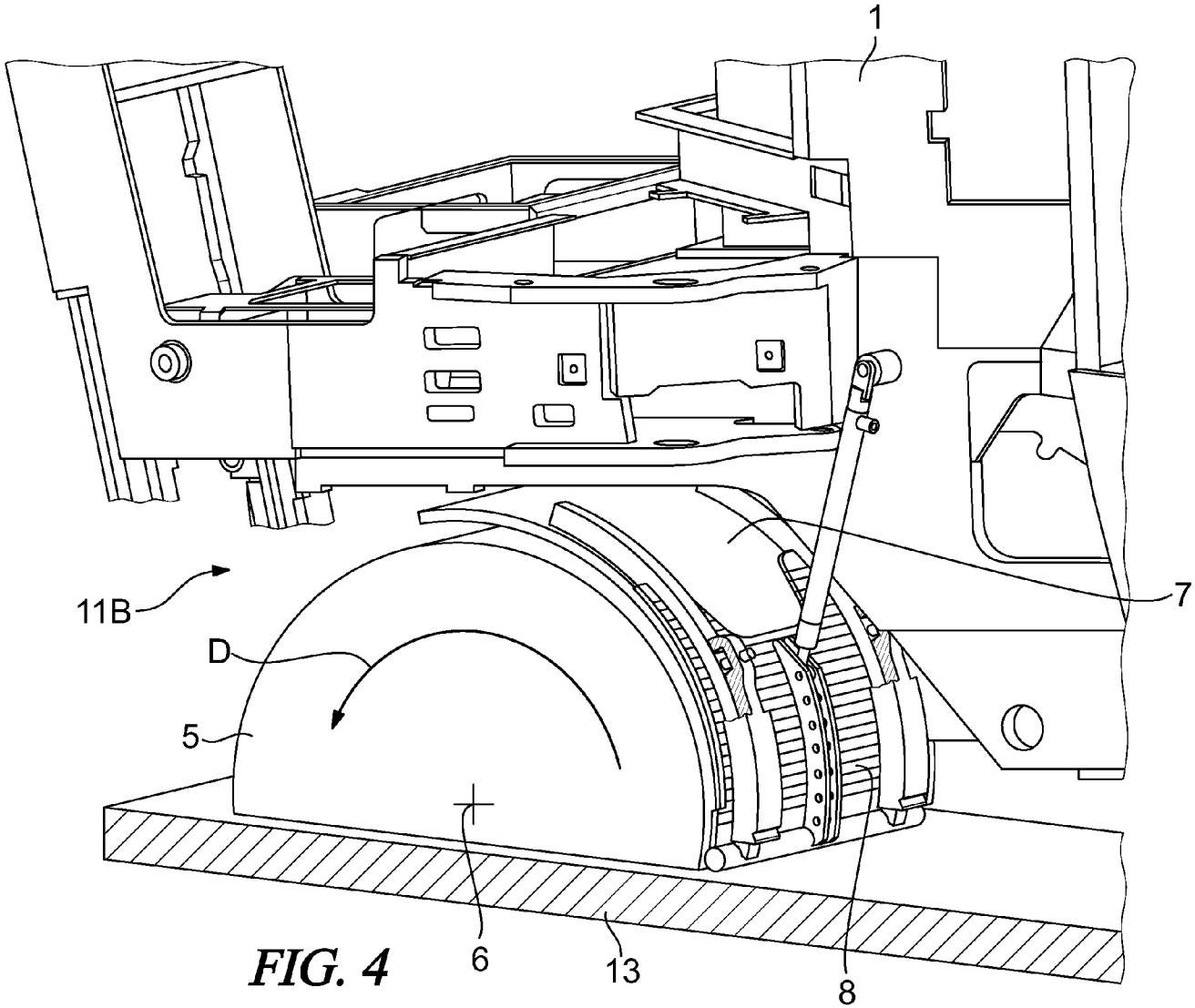

The height of the hold-down device 8 can be adjusted according to the milling depth. FIGS. 2 to 4 show how the milling drum penetrates into the material to be milled off in the vertical direction. While the milling drum is penetrating into the material, the hold-down device 8 is moved from a first position, shown in FIG. 2, in which the hold-down device 8 is fully lowered, into a second position, in which the hold-down device is fully raised (FIG. 4). The maximum milling depth is obtained in this position. FIG. 3 shows a middle position of the hold-down device 8 with a smaller milling depth. In the present embodiment, the closed milling drum housing 7, closed at the front, along with the hold-down device 8 completely surrounds the milling drum 5 over a circumferential angle of approximately 180°.

Figure 5:
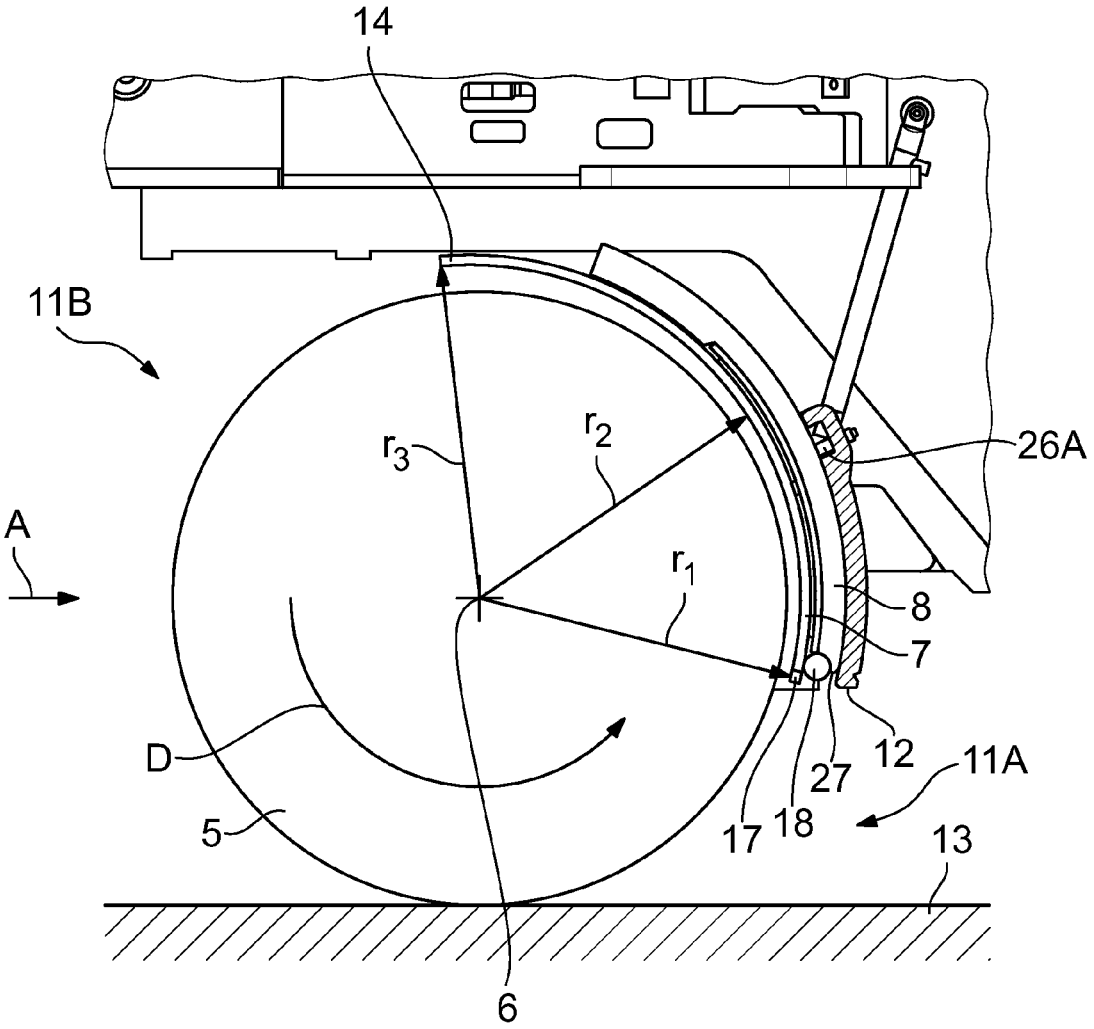
Figure 6:
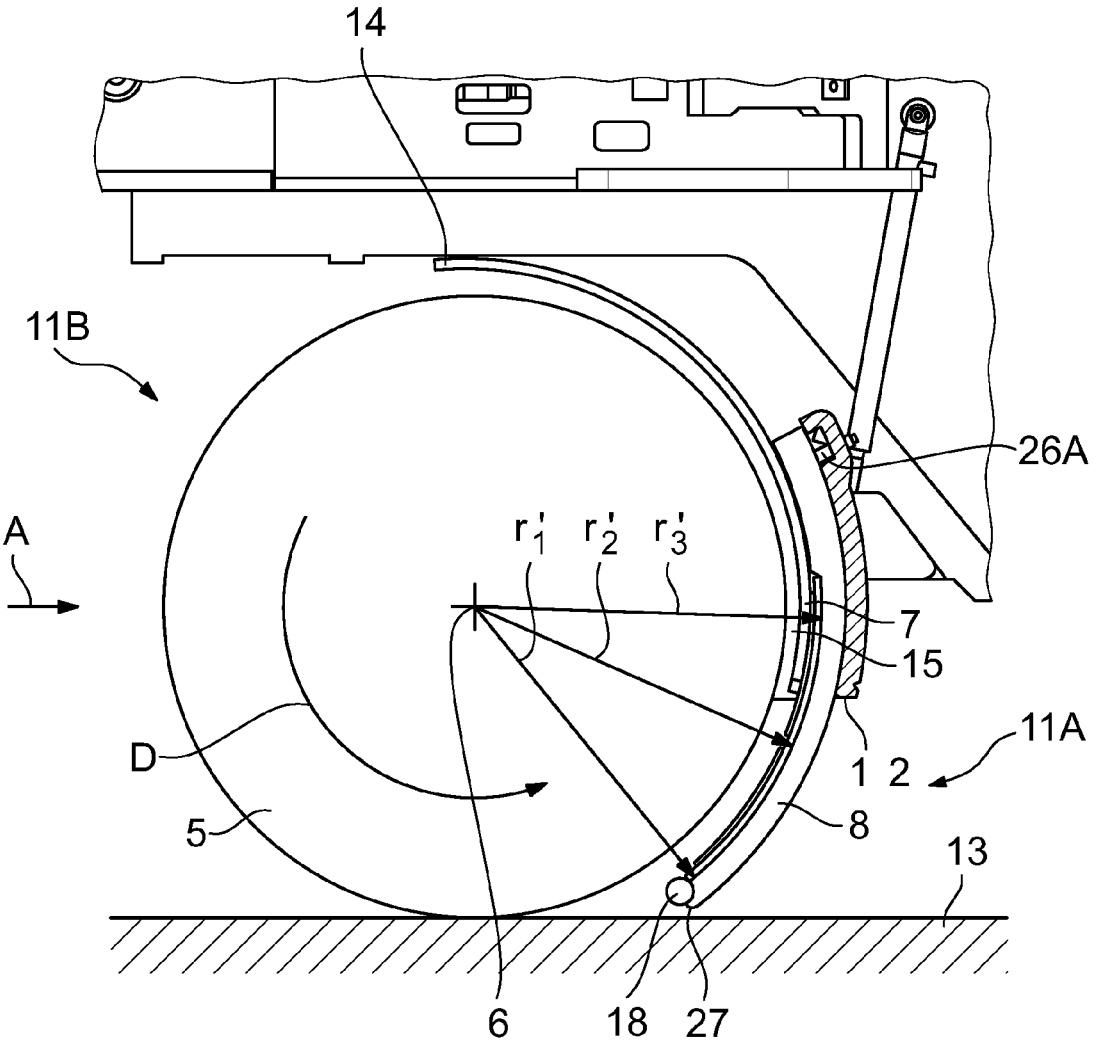

FIGS. 5 and 6 show a sectional view, wherein the hold-down device 8 is in the raised position (FIG. 5) and in the lowered position (FIG. 6). The hold-down device 8 closes the opening 11A pointing in the operating direction between the lower edge 12 of the hold-down device 8 and the surface of the road pavement material 13 to be milled off.

The milling drum housing 7, surrounding the milling drum 5 over a circumferential angle of more than 90°, preferably has a spiral contour. The cross-section of the milling drum housing 7 describes a curve which, in the running direction, is spaced from the axis of rotation about the axis of rotation 6 of the milling drum 5, wherein the running direction of the curve corresponds to the turning direction of the milling drum 6. The milling drum housing 7 is configured so that the distance between the axis of rotation 6 and the inside of the milling drum housing 7 continuously increases from the lower edge 17 up to the upper edge 14. Consequently, the radius $r_1<r_2<r_3$. For this reason, the width of the gap between the milling drum body 5 surrounding the tips of the milling tools 5 and the inside of the milling drum housing 7 continuously increases from the bottom to the top. However, the increase need not necessarily be continuous. It is only important that the gap width enlarges.

It is preferred that the hold-down device, in particular, has a spiral contour. The cross-section of the hold-down device describes a curve which, in the running direction, is spaced from the axis of rotation about the axis of rotation 6 of the milling drum 5, wherein the running direction of the curve corresponds to the turning direction of the milling drum 6. The hold-down device and the lower section of the milling drum housing 7 can have precisely the same curvature. In this case, milling drum housing and hold-down device can lie with one precisely in top of the other in the raised position. However, it is also possible for the spiral contour of the milling drum housing 7 to be continued in the hold-down device 8 when the hold-down device 8 is in the lowered position. The milling drum housing and hold-down device cannot then lie precisely with one on top of the other in the raised position. In practice, the two embodiments exhibit no significant differences.

The gap width, preferably increasing over the whole periphery of the milling drum housing 7 and the hold-down device 8 from bottom to top improves the flow of milled material along the gap 15, in particular between the milling drum 5 and hold-down device 8 against the operating direction A of the milling machine. The milled material, whose packing density decreases in the direction of rotation D of the milling drum 5, and whose volume increases, can be conveyed continuously into the gap 15 with increasing gap width. The power required for driving the milling drum and the wear on the milling tools are thereby relatively small.

FIG. 6 shows the hold-down device 8 in the lowered position, wherein the distance between the inside of the hold-down device 8 and the axis of rotation 6 of the milling drum 5 is referenced with $r_1'$, $r_2'$, and $r_3'$ ($r_1'<r_2'<r_3'$).

In practice, it has been shown that the gap width can vary over the whole periphery of the milling drum between 15 and 80 mm, preferably between 25 and 50 mm. It is not absolutely necessary for the gap width to increase continuously over the whole periphery of the milling drum.

In the present embodiment, the gap width in the region of the hold-down device 8 is larger than that at the lower edge 17 of the milling drum housing 7. In this embodiment, lumps of removed material can still reach the milling drum housing, which forms a gap with increasing gap width with the milling drum. Therefore, in the present embodiment, a breaker element may be positioned within the gap 15, extending in the direction of the axis of rotation 6. Coarser material remaining in the gap 15 can be broken up with the breaker element.

Figure 7:
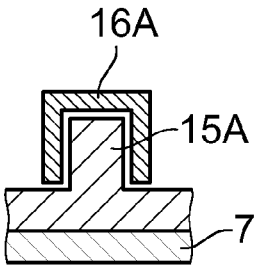
Figure 8:
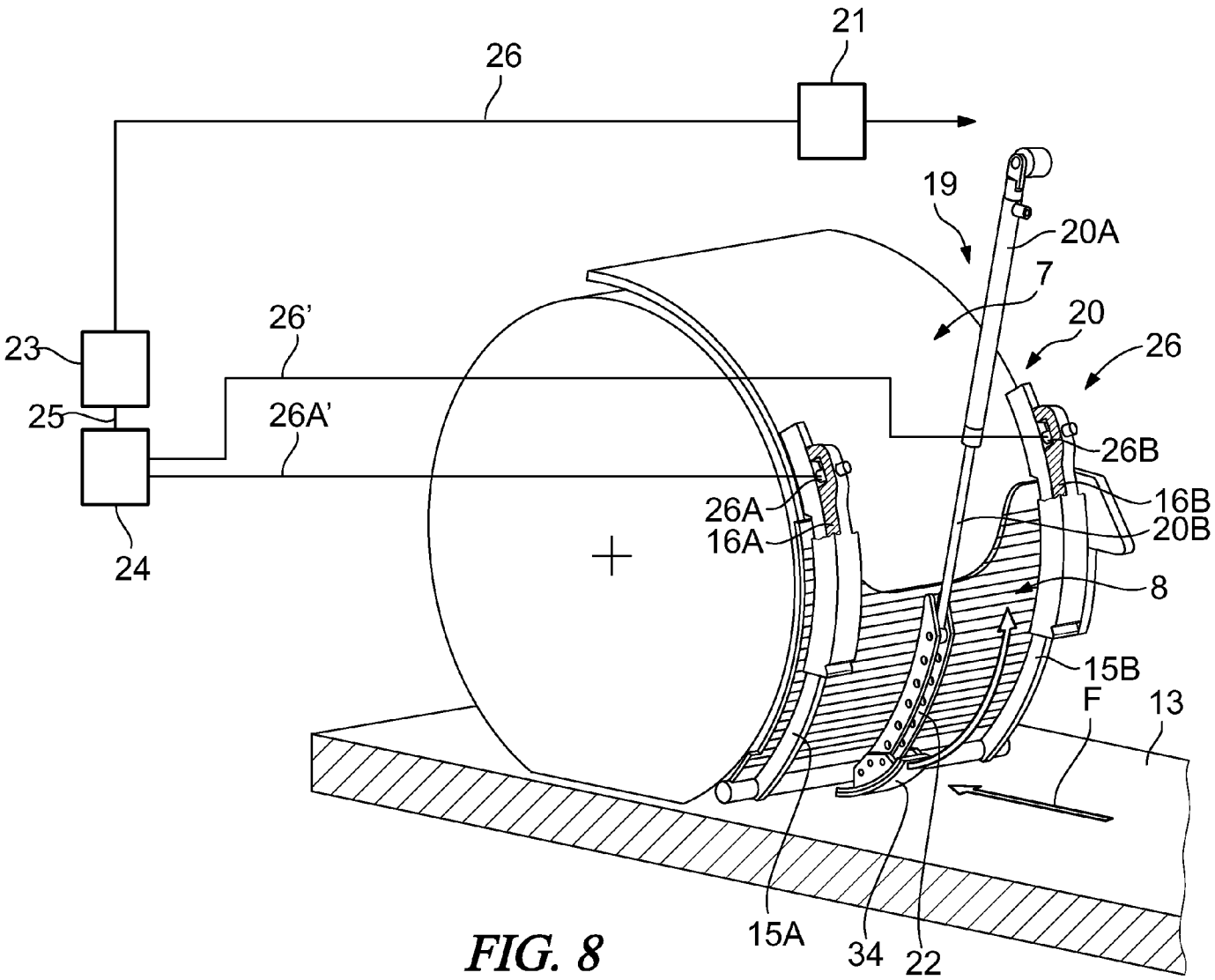

FIG. 8 shows a schematic representation of the guide of the hold-down device 8. On the outside, the hold-down device has a guide rail 15A, 15B on either side extending upwards over the periphery. The guide rails 15A and 15B are guided in mounting elements 16A and 16B, which are fastened on the machine frame 1. The fastening of the mounting elements is not shown in FIG. 7.

FIG. 7 shows a section through the guide rails 15A, 15B and mounting elements 16A, 16B. The mounting elements 16A, 16B have a U-shaped cross-section, in which the guide rails 15A, 15B are longitudinally displaceable. Since the mounting elements 16A, 16B encompass the guide rails 15A, 15B, the guide rails are secured in axial and radial directions. When the hold-down device 8 is in the lowered position, the sections of the guide rails 15A, 15B extending upwards are supported on the milling drum housing 7. Because of this, even greater forces can be absorbed.

At the lower edge 27, the hold-down device 8 has a sliding element 18 extending along the lower edge, which can be a sliding bar. The hold-down device 8 slides with the sliding element 18 on the surface of the road pavement 13. In doing so, the hold-down device 8 is supported on the road pavement solely due to its weight. When the milling drum 5 penetrates into the road surface in the vertical direction, the hold-down device 8 moves upwards in the guide.

In the present embodiment, a mechanism 19 is provided for raising and lowering the hold-down device 8. In particular, supporting the upward movement of the hold-down device 8 when the milling depth is varied.

The mechanism 19 for raising and lowering the hold-down device 8 comprises a piston/cylinder arrangement 20. The piston/cylinder arrangement 20 is operated by a hydraulic unit 21, shown only in outline, which supplies a hydraulic fluid to the cylinder 20A of the piston/cylinder arrangement 20.

The cylinder 20A of the piston/cylinder arrangement 20 has an articulated connection to the machine frame 1 and the piston 20B has an articulated connection to the upper end of a U-shaped profile element 22, which is fastened to the hold-down device 8. The hold-down device 8 can be raised and lowered by admitting hydraulic fluid to the cylinder 20A.

The mechanism 19 for raising and lowering the hold-down device 8 further has a control unit 23 and a processing unit 24, which are connected together by means of a data line 25. The control unit 23, which is connected to the hydraulic unit 21 by a control line 26, controls the hydraulic unit 21, so that the piston/cylinder arrangement 20 keeps the hold-down device 8 in contact with the ground with a predetermined downwards force. For example, the hydraulic unit can release the piston in the cylinder, so that the hold-down device 8 rests on the ground under its weight if the hold-down device 8 is not raised when it strikes an obstacle.

The mechanism 19 for raising and lowering the hold-down device 8 further comprises a measuring unit 26 for measuring the force exerted on the hold-down device 8 on impact with an obstacle. Preferably, only the horizontal force component acting on the sealing element is measured by the measuring unit.

The processing unit 24 compares the impact force measured by the measuring unit 26 with a predetermined limit value. When the impact force is greater than the limit value, the control unit 23 generates a first control signal for the hydraulic unit 21 to raise the hold-down device 8, so that the hydraulic unit 21 actuates the piston 20B of the piston/cylinder unit 20. The hold-down device 8 is raised by the piston/cylinder unit 20 until the measured impact force is again less than the predetermined limit value. When the impact force is smaller than the limit value, the control unit 23 generates a control signal for the hydraulic unit 21, with which the piston/cylinder arrangement 20 is actuated once more to lower the hold-down device 8 again until the lower edge 27 of the hold-down device 8 again rests on the ground with the predetermined downwards force. Alternatively, the piston/cylinder arrangement 20 can also release the hold-down device 8, so that the hold-down device moves downwards in the guide under its own weight.

The measuring unit 26 has two sensors 26A, 26B, for measuring the impact force, positioned between the mounting elements 16A, 16B and the guide rails 15A, 15B, in the area in which the guide rails extend upwards beyond the hold-down device 8. When an essentially horizontal force acts on the hold-down device, the ends of the guide rails exert a contact pressure on the ends of the mounting elements, which is measured by the two sensors 26A, 26B. The sensors 26A, 26B are connected to the processing unit 24 by signal lines 26A' and 26B'. The processing unit 24 processes the measurement signals of the two sensors. Either only one or the other measurement signal can be processed, or both measurement signals together. For example, the two measurement signals can be averaged. Suitable pressure sensors and the processing of the measurement signals are part of the state of the art. A skid 34 can also be provided on the hold-down device, to support the upwards movement and to introduce the force on impact with an obstacle.

What is claimed is:

1. A road milling machine for milling a ground surface, comprising:

a machine frame;

a milling drum housing supported from the machine frame such that an opening exists between the milling drum housing and the ground surface;

a milling drum positioned in the milling drum housing and rotatable in a predetermined direction of rotation about an axis of rotation; and a hold-down device arranged to close the opening, the hold-down device being configured such that a gap is defined between the milling drum and the hold-down device, and a distance between the axis of rotation and the hold-down device increases upward in the predetermined direction of rotation at least over a section of the gap.

2. The road milling machine of claim 1, wherein:

the gap increases upward from a lowermost end of the hold-down device.

3. The road milling machine of claim 1, further comprising:

left and right rear ground engaging units supporting the machine frame from the ground surface;

a conveyor extending rearwardly from the milling drum housing; and wherein the milling drum is located between the left and right rear ground engaging units.

4. The road milling machine of claim 1, wherein:

the hold-down device is curved.

5. The road milling machine of claim 1, wherein:

the milling drum is fixed in position relative to the milling drum housing.

6. The road milling machine of claim 1, wherein:

the milling drum operates in an upcut manner.

7. The road milling machine of claim 1, wherein:

the milling drum housing is configured such that a distance between the axis of rotation and the milling drum housing increases in the predetermined direction of rotation.

8. The road milling machine of claim 1, further comprising:

a guide track; and wherein the hold-down device is displaceably guided on the guide track between a first position in which the hold-down device is lowered, and a second position in which the hold-down device is raised.

9. The road milling machine of claim 8, wherein:

the milling drum housing has a housing lower edge;

the hold-down device has a hold-down device lower edge, and when the hold-down device is in the raised position the hold-down device lower edge is substantially adjacent the housing lower edge.

10. The road milling machine of claim 1, further comprising:

first and second guide elements located on an outer surface of the hold-down device;

first and second mounting elements supported from the machine frame; and wherein the guide elements of the hold-down device are displaceably guided in the mounting elements.

11. The road milling machine of claim 10, wherein:

the mounting elements are fastened to the machine frame.

12. The road milling machine of claim 10, wherein:

the guide elements extend beyond the hold-down device so that the guide elements surround a part of the milling drum housing.

13. The road milling machine of claim 1, wherein:

the hold-down device includes a lower edge and a sliding element positioned along the lower edge.

14. The road-milling machine of claim 1, further comprising:

a skid positioned adjacent a lower edge of the hold-down device.

15. The road-milling machine of claim 1, further comprising:

an actuator configured to raise and lower the hold-down device.

16. The road-milling machine of claim 15, wherein:

the actuator includes at least one piston and cylinder arrangement including a cylinder and a piston, one of the cylinder and piston having an articulated connection to the machine frame, and the other of the cylinder and piston having an articulated connection to the hold down device.

* * * * *